US007832035B2

(12) United States Patent
Walczyk

(10) Patent No.: US 7,832,035 B2
(45) Date of Patent: Nov. 16, 2010

(54) SURGICAL SUPPORT FOR PATIENT LIMB

(76) Inventor: Stephen L. Walczyk, 2928 Ryan Rd., Weedsport, NY (US) 13166

( * ) Notice: Subject to any disclaimer, the term of this patent is extended or adjusted under 35 U.S.C. 154(b) by 500 days.

(21) Appl. No.: 11/656,189

(22) Filed: Jan. 22, 2007

(65) Prior Publication Data

US 2008/0172791 A1 Jul. 24, 2008

(51) Int. Cl.
*A47C 17/86* (2006.01)

(52) U.S. Cl. ..... 5/648; 5/623; 5/624; 5/646

(58) Field of Classification Search ..... 5/621, 5/623, 624, 646, 648, 507.1; 128/845; 108/4, 108/10; 248/118, 118.3, 351, 689
See application file for complete search history.

(56) References Cited

U.S. PATENT DOCUMENTS 1,516,795 A * 11/1924 Schwarting ..... 5/646
2,306,031 A * 12/1942 Anderson et al. ..... 5/602
2,614,558 A * 10/1952 Lovell ..... 602/20
4,163,536 A 8/1979 Heller et al. ..... 248/118
4,390,011 A * 6/1983 Evans ..... 5/507.1
4,730,801 A 3/1988 Cloward ..... 248/118
4,913,393 A * 4/1990 Wood ..... 248/230.2
5,152,486 A 10/1992 Kabanek et al. ..... 248/201
5,560,577 A * 10/1996 Keselman ..... 248/279.1
6,629,944 B2 * 10/2003 Smart ..... 602/36
6,663,055 B2 * 12/2003 Boucher et al. ..... 248/118
6,691,350 B2 * 2/2004 Weismiller ..... 5/621
6,758,447 B2 * 7/2004 Tinsley ..... 248/118
6,983,501 B2 * 1/2006 Heimbrock et al. ..... 5/602
2001/0022334 A1 9/2001 Iwata et al. ..... 248/118

* cited by examiner

*Primary Examiner*—Robert G Santos
*Assistant Examiner*—Nicholas Polito
(74) *Attorney, Agent, or Firm*—Bernhard P. Molldrem, Jr.

(57) ABSTRACT

A surgical arm rest or leg rest for supporting a patient's limb has concave tray or trough supported on a post member that extends downward. An elongated rod member situated below the tray with clamp member adjustably supports the post of the tray. A clamp member permits the rotation angle and tilt angle of the support post to be adjusted. An L-shaped support arm has a vertical arm portion adapted to be received into a support clamp mounted on the surgical table, and a horizontal arm that holds a sleeve member which supports the rod member. A locking lever on the sleeve member locks the rod member in place in the sleeve member.

10 Claims, 3 Drawing Sheets

SURGICAL SUPPORT FOR PATIENT LIMB

BACKGROUND OF THE INVENTION

This invention relates to medical and surgical devices, and is more particularly concerned with devices and apparatus for stabilizing and supporting a patient's arm or leg during a surgical procedure or other medical procedure.

In some surgical procedures, in particular those which may involve the side of the thorax or rib cage, it is necessary for the patient to hold his or her arm in an elevated position. If the arm position changes during surgery, it can make the procedure more complex. However, to date no effective support device has been proposed as a rest for the patient's limb, i.e., arm or leg, while undergoing surgery or other medical procedure.

A foam cushion type arm rest exists, as discussed in U.S. Pat. No. 4,730,801 to Cloward. However, that device is only intended as a cushioning stabilizer for a patient that is oriented into a prone position. The patient's arms are not elevated above the head, and thus the Cloward arm rest is suitable mostly or entirely for procedures where the patient has to lie face down; that same cushioning system could not be used for a procedure where the patient's arm must be kept at an elevated position where the patient is lying on his or her side. Also, because the Cloward device is made of foam plastic, it is difficult or impossible to render sterile after a procedure, and thus has to be discarded, thereby elevating the costs of surgery.

There are other procedures as well where the patient's leg needs to be elevated at a particular height and a particular angle, but there is no convenient means now available to hold the patient's lower limb comfortably and stably.

OBJECT AND SUMMARY OF THE INVENTION

Accordingly, it is an object of the invention to provide an effective support for a patient's arm or leg during a surgical operation and which avoids the drawbacks of the prior art.

It is another object to provide a patient arm rest or leg rest for surgical use, which is sturdy and convenient to use.

It is a further object to provide a patient arm rest or leg rest which is formed or materials that can be made clean and sterile for numerous re-uses.

It is a still further object to provide a patient arm rest or leg rest that can be oriented into a wide range of heights and angles to suit the need to orient any patient limb in any given position.

According to one aspect of this invention, an arm rest or leg rest is adapted for use in supporting a patient's limb during a surgical operation that is carried out with the patient lying on a surgical table. A concave tray supports the patient's limb. A support post extends downward from the tray and has an upper end affixed onto a lower side of the tray. An elongated rod member is situated below the tray. A clamp member attached at an upper end of the rod member adjustably supports the support post of the tray. The clamp member includes means permitting the rotation angle and tilt angle of the support post to be adjusted. A lower support member, e.g., an L-shaped support member, has a first portion, such as a vertical arm, adapted to be received into a support clamp that is mounted on the surgical table, and has second portion, such as a horizontal cross arm, that holds a sleeve member through which the rod member passes and is adjustably supported. A locking means on the sleeve member releasably holds the rod member in place in the sleeve member. Preferably, the tray can be a trough having a generally cylindrical concave arm-support surface. The support post is preferably in the form of an elongated rod having an upper end affixed to a bracket that is secured to the lower side of the tray.

In one preferred example, the elongated rod member is L-shaped and has a horizontal arm portion at its upper end; the clamp member has a clamp body that is releasably tightened over the horizontal arm portion of the rod member. In that case, the clamp member may further include a clamp sleeve that releasably retains the post member. The clamp member then can also employ a draw screw for tightening the clamp sleeve and clamp body around the horizontal arm portion of the rod member and the post member. A locking lever can be employed for rotating the draw screw.

In a preferred embodiment, the sleeve member is in the form of a ring member affixed at one end of the horizontal arm of said L-shaped member. The sleeve member may include a retaining screw in a threaded aperture through the ring member, with the latter being tightenable against the rod member.

The tray and all the support portions may be fabricated from a surgical grade of stainless steel, so the entire device can be easily cleaned and sanitized.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
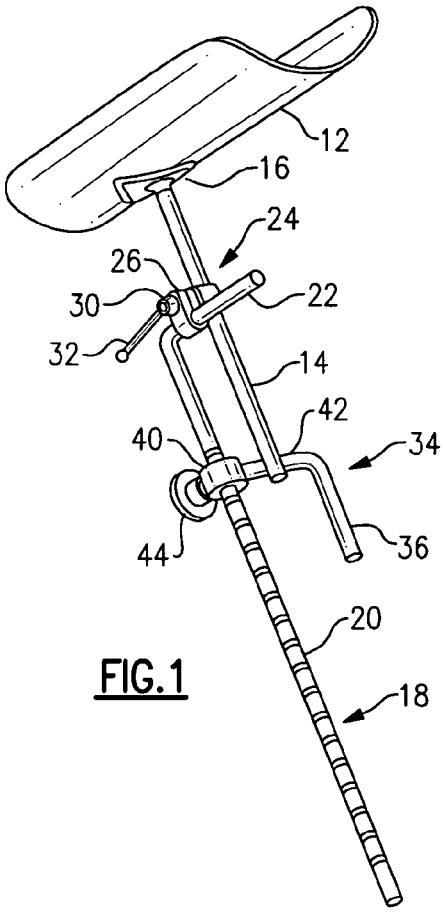
FIG. 1 is a perspective view of a surgical limb support according to one embodiment of the present invention.
Figure 2:
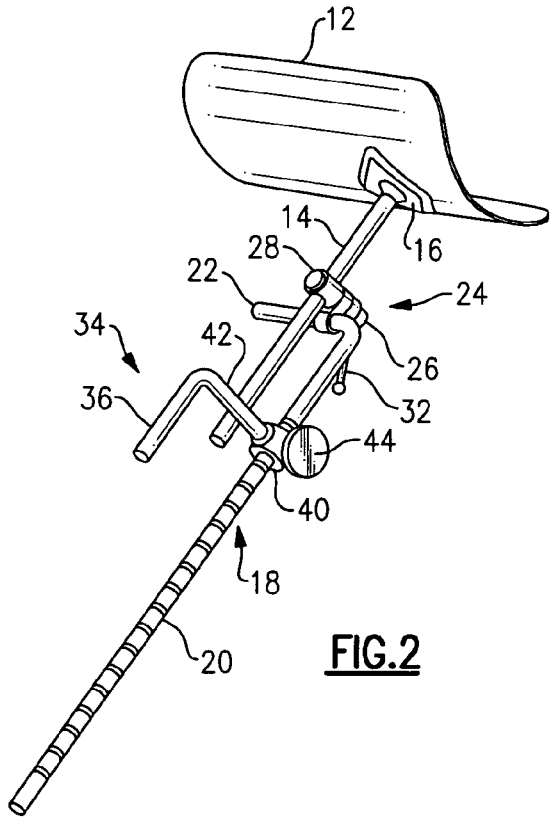
FIG. 2 is a perspective view from an different side, showing this embodiment.

With reference to the Drawing, and initially to FIGS. 1 and 2, a surgical arm rest assembly 10 has a stainless steel tray 12, here in the form of a portion of a cylinder, being arcuate in the cross-ways direction and generally straight in the lengthwise direction, as shown. The tray 12 can be about sixteen to twenty inches in length, to correspond generally to the size of a patient's forearm. A post or rod 14 extends downward from the underside of the tray 12, and a diamond-shaped brace 16 secures the rod to the under surface of the tray 12. A long arm 18, which is in the form of a generally L-shaped rod or post of circular cross section, has a vertical arm portion 20 that is elongated in the vertical direction and extends for twenty-four to thirty inches. The long arm 18 has a cross arm portion 22 at its upper end that extends at a right angle, i.e., horizontally, for about six inches. A clamp member 24 is secured at an upper end of the long arm 18 and in this embodiment the clamp member has a clamp body 26 can be releasably tightened over the horizontal cross arm portion 22. The clamp member 24 has a tubular sleeve portion 28 that is releasably tightened around the post 14 for retaining the same in a desired position. This clamp member 24 further includes a draw screw 30 with a locking lever 32 for tightening the clamping sleeve and clamp body around the post member and the horizontal cross arm of the rod member. A knob or other handle could be used instead of the locking lever.

Figure 2A:
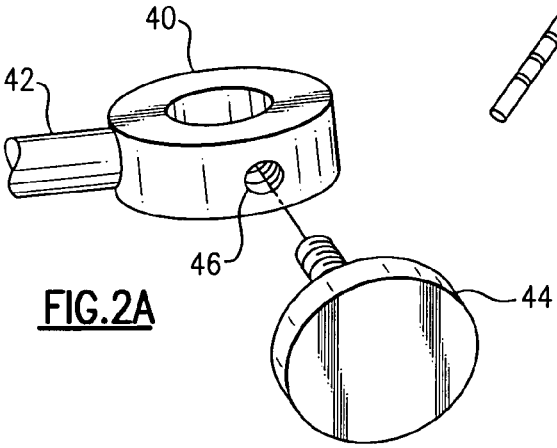
FIG. 2A shows a detail of a portion of FIG. 2.

A short arm 34, in the form of an L-shaped member of round stock, e.g., a rod, forms a support member with a vertical leg 36 that can be received into a support clamp 38 (see FIG. 3) that is mounted on a surgical table. A locking sleeve member 40 is fitted onto a horizontal cross arm 42 of this short arm 32. The vertical arm portion 20 of the long arm 18 fits adjustably into this sleeve member 40, and can be locked in place by rotating a retaining screw 44 fitted into a threaded aperture 46 in the sleeve 40 (see FIG. 2A). In this case, the retaining screw has a knurled head in the form of a knob, but in other embodiments, a lever can be used here.

Figure 3:
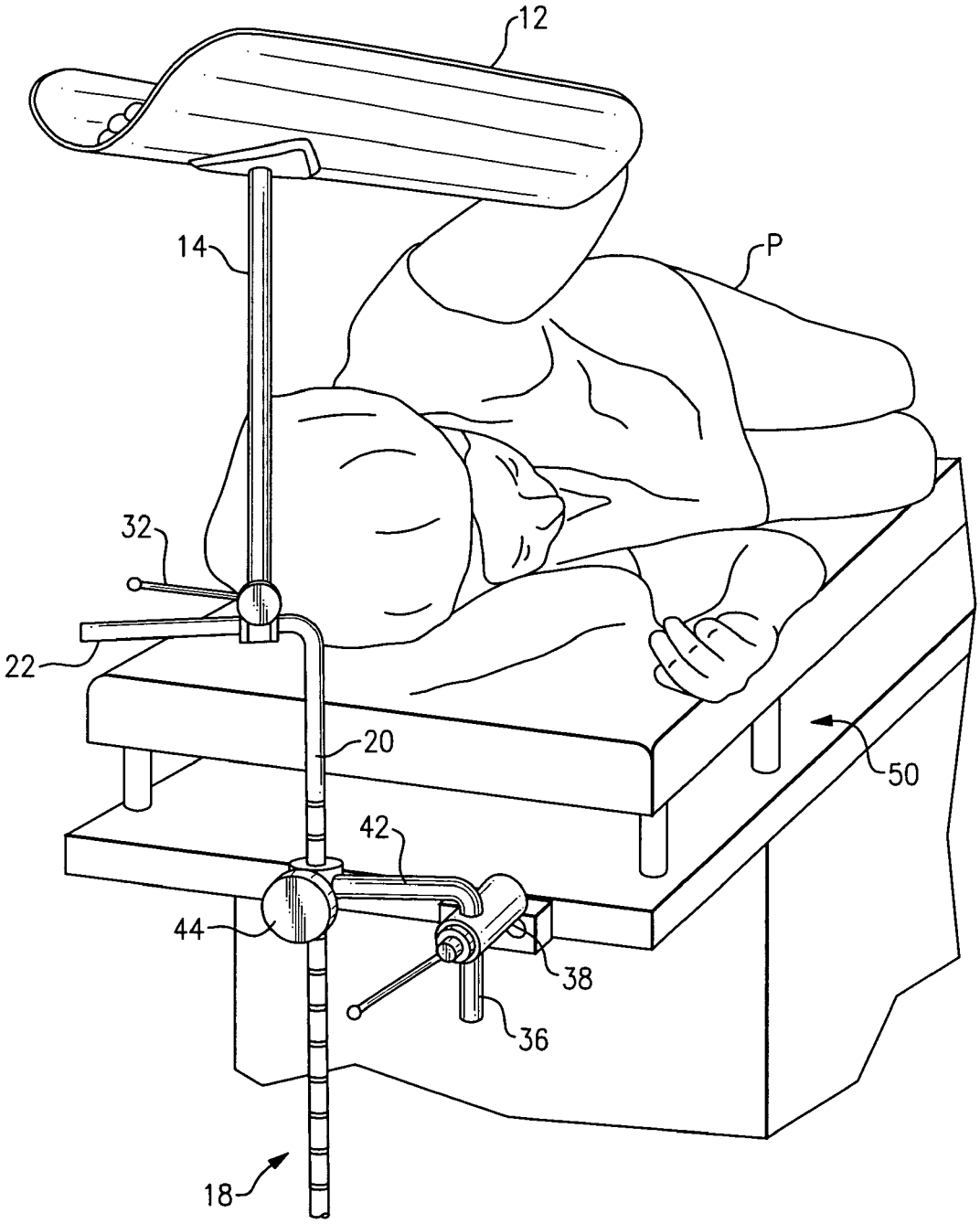
FIG. 3 is an environmental perspective view showing the limb support of this embodiment used in supporting the arm of a patient lying on a surgical table.

One implementation of this invention is demonstrated in FIG. 3. Here, a patient P is situated on a surgical table 50, lying on her right side with her left arm elevated. The patient's left forearm is resting in the tray 12 of the support assembly. The vertical leg portion 36 of the short arm 34 is secured into the clamp 38, which is mounted onto a side of the surgical table 50. The azimuthal angle of the short arm 34 can be adjusted at this clamp 38. The height of the tray 12 and its angular orientation can be adjusted by setting the height of the long arm 18 and the post 14 by adjustment of the sleeve member 40 and the clamp member 24. Likewise the tilt angle of the tray 12 as well as its pitch and azimuth can be adjusted by rotating the horizontal cross arm portion 22 of the long arm and by adjusting the angle of the clamp member 24. This permits the surgical support 10 to be individualized to the particular patient, so that the limb is supported comfortably and securely during the surgical procedure.

Figure 4:
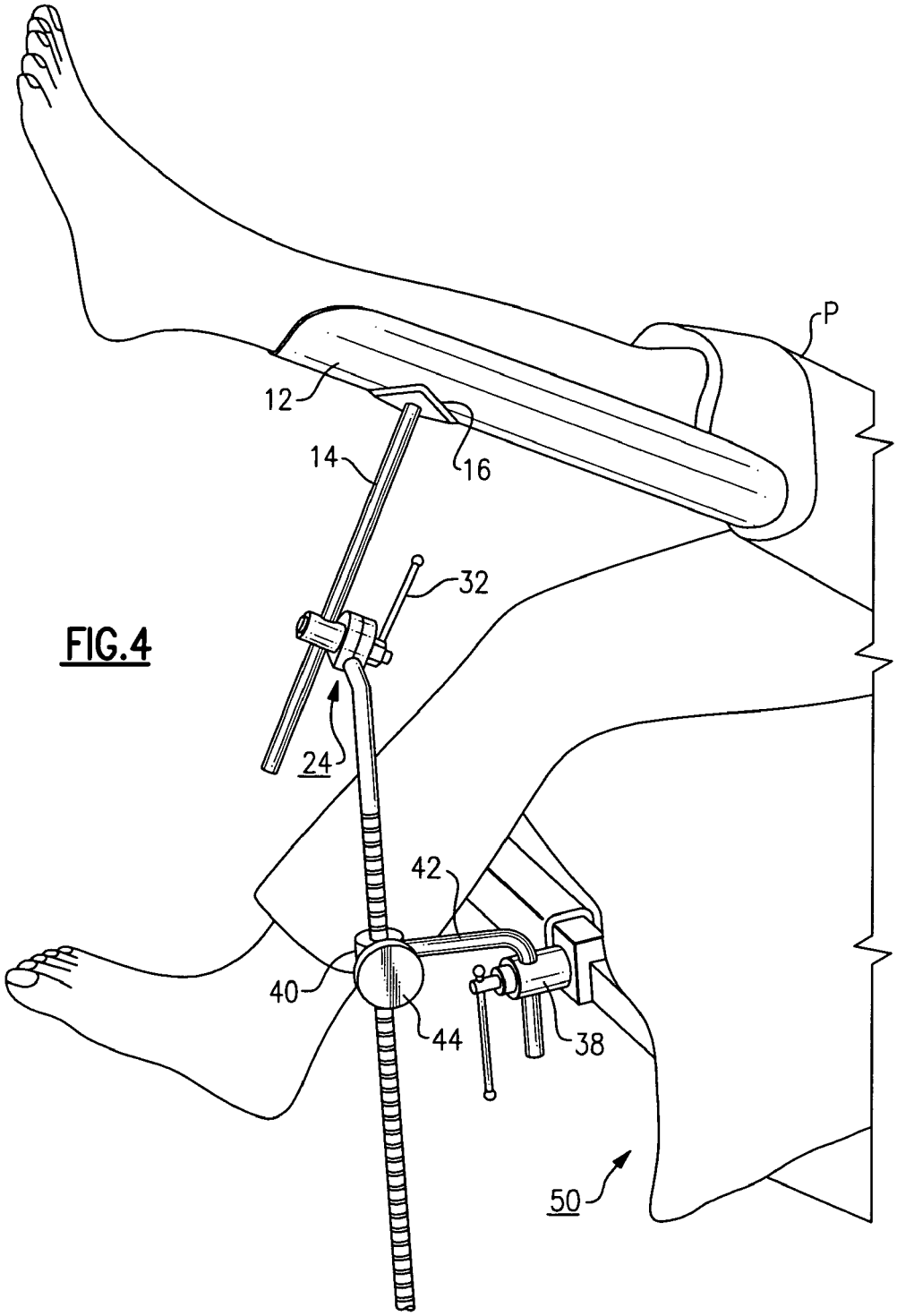
FIG. 4 shows another implementation of this invention, with the limb support used in supporting the leg of a patient.

FIG. 4 shows an alternative view, in which the tray is set at a different tilt angle and different elevation to support the leg of a patient P during a different surgical procedure. Here it is seen that the tray 12 is asymmetrically supported on the post 14, with one end extending farther out. Here the tray is rotated such that the longer end extends below the patient's knee. The angles of the short arm 38 and the clamp 24 are oriented as appropriate to ensure that the surgical support 10 is properly positioned to the patient.

As shown in both FIG. 3 and FIG. 4, the long arm 18 is positioned to place the clamp 24 and lever 32 above the patient table, so the surgeon can make positional adjustments.

While the surgical limb support of this invention has been described in reference to one preferred embodiment, it should be understood that the invention is not limited to that precise embodiment. The tray 12 could be made of other materials, or could have a somewhat different shape. Also, the long arm 18 and short arm 34 can be varied from what is shown, as can the clamp member 24 and the locking sleeve 40. Many equivalent alternatives can apply. Indeed, many modifications and variations will present themselves to those skilled in the art without departing from the scope and spirit of the invention, as defined in the appended claims.

I claim:

1. Arm rest or leg rest for use in supporting a patient's limb during a surgical operation that is carried out with the patient lying on a surgical table, comprising:

a concave tray on which the patient's limb rests;

a support post extending downward from the tray and having an upper end affixed onto a lower side of the tray;

a long arm member which is formed of a vertical elongated rod member and an upper end portion positioned vertically higher than said surgical table within a field above said surgical table;

a clamp member attached at an upper end portion of the long arm member and which adjustably supports the support post of the tray, the clamp member including means including a single adjustment lever permitting vertical height adjustment along the support post axis, and permitting pitch angle, azimuth angle and tilt angle of the support post to be adjusted relative to said upper end member, by use of said single adjustment lever for positioning within the field above said surgical table; and a lower support member in the form of a short arm member having a first portion adapted to be received into a support clamp mounted on said surgical table, and a second portion incorporating an annular a sleeve member through which the elongated rod member of the long arm member passes and is adjustably supported, and locking means for releasably holding said elongated rod member in place in said sleeve member permitting preliminary adjustment of said long arm member outside of said field.

2. The arm rest or leg rest of claim 1 wherein said tray is in the form of a generally cylindrical trough.

3. The arm rest or leg rest of claim 1 wherein said support post is in the form of an elongated rod having an upper end affixed to a bracket that is secured to the lower side of said tray.

4. The arm rest or leg rest of claim 1 wherein said long arm member is L-shaped and has a horizontal arm portion as its upper end portion; and wherein said clamp member has a clamping sleeve that is releasably tightened over the horizontal arm portion of the long arm member.

5. The arm rest or leg rest of claim 4 wherein said clamp member further includes a clamp body releasably retaining the post member and permitting vertical adjustment of said post member in said clamp body.

6. The arm rest or leg rest of claim 5 wherein said clamp member further includes a draw screw for tightening said clamping sleeve and said clamp body around the horizontal arm portion of said long arm member and said post member.

7. The arm rest or leg rest of claim 6, further including a locking lever for rotating said draw screw.

8. The arm rest or leg rest of claim 1 wherein said sleeve member is in the form of a ring member affixed onto the second portion of said lower support member.

9. The arm rest or leg rest of claim 8 wherein said sleeve member includes a retaining screw in a threaded aperture through said ring member and which is tightenable against said long arm member.

10. The arm rest or leg rest of claim 1 wherein said lower support member is in the form of an L-shaped member with said first portion being a vertical arm and said second portion being a horizontal cross arm.

* * * * *